US007992416B2

(12) United States Patent
Stonitsch et al.

(10) Patent No.: US 7,992,416 B2
(45) Date of Patent: Aug. 9, 2011

(54) ULTRASONIC PEENING TREATMENT OF ASSEMBLED COMPONENTS

(75) Inventors: Raymond Joseph Stonitsch, Simpsonville, SC (US); Diane Marie Beagle, Simpsonville, SC (US); Jean-Michel Duchazeaubeneix, Les Sorinieres (FR); Patrick Cheppe, Basse Goulaine (FR); Philippe Jacob, Orvault (FR); Vincent Desfontaine, Blainville (CA)

(73) Assignee: General Electric Company, Schenectady, NY (US)

( * ) Notice: Subject to any disclaimer, the term of this patent is extended or adjusted under 35 U.S.C. 154(b) by 463 days.

(21) Appl. No.: 12/439,712

(22) PCT Filed: May 12, 2006

(86) PCT No.: PCT/US2006/018469

§ 371 (c)(1), (2), (4) Date: Mar. 3, 2009

(87) PCT Pub. No.: WO2006/124616

PCT Pub. Date: Nov. 23, 2006

(65) Prior Publication Data

US 2009/0308123 A1 Dec. 17, 2009

Related U.S. Application Data

(60) Provisional application No. 60/680,039, filed on May 12, 2005.

(51) Int. Cl.

| | |
|---|---|
| ***B24C 1/00*** | (2006.01) |
| ***B05D 3/12*** | (2006.01) |
| ***C21D 7/00*** | (2006.01) |

(52) U.S. Cl. ..... 72/53; 29/90.7; 451/38; 451/39

(58) Field of Classification Search ..... 72/53; 29/90.7; 451/38, 39

See application file for complete search history.

(56) References Cited

U.S. PATENT DOCUMENTS

| | | | | |
|---|---|---|---|---|
| 6,289,705 | B1 * | 9/2001 | Duquenne et al. | 72/53 |
| 6,336,844 | B1 * | 1/2002 | Duquenne et al. | 451/36 |
| 6,490,899 | B2 * | 12/2002 | Berthelet et al. | 72/53 |
| 6,505,489 | B2 * | 1/2003 | Berthelet et al. | 72/53 |
| 6,508,093 | B2 * | 1/2003 | Berthelet et al. | 72/53 |
| 6,536,109 | B2 * | 3/2003 | Berthelet et al. | 29/90.7 |
| 7,389,663 | B2 * | 6/2008 | Cheppe et al. | 72/53 |
| 7,665,338 | B2 * | 2/2010 | Cheppe et al. | 72/53 |
| 2002/0069687 | A1 * | 6/2002 | Berthelet et al. | 72/53 |
| 2006/0021410 | A1 * | 2/2006 | Cheppe et al. | 72/53 |
| 2008/0092616 | A1 * | 4/2008 | Cheppe et al. | 72/53 |

* cited by examiner

*Primary Examiner* — David Jones
(74) *Attorney, Agent, or Firm* — Nixon & Vanderhye P.C.

(57) ABSTRACT

Ultrasonic peening treatment is desirable where an application of a compressive stress is helpful to reduce the incidence of crack formation on highly stressed parts. Ultrasonic peening treatment can be performed in field applications without requiring a rotor to be removed from the machine. The system includes an acoustic element that excites peening media within a peen chamber. A frame is attachable to an assembled turbine rotor component and includes support structure engageable with the acoustic element. The frame is cooperable with a chamber tooling that defines and encloses the peen chamber together with the turbine rotor component.

13 Claims, 5 Drawing Sheets

ULTRASONIC PEENING TREATMENT OF ASSEMBLED COMPONENTS

CROSS-REFERENCES TO RELATED APPLICATIONS

This application is the U.S. national phase of International Application No. PCT/US2006/018469 filed 12 May 2006 which designated the U.S. and claims priority to U.S. Provisional Patent Application Ser. No. 60/680,039 filed 12 May 2005, the entire contents of each of which are hereby incorporated by reference.

BACKGROUND OF THE INVENTION

The present invention relates to peening of assembled rotor parts while still in the casing or unit rotor and, more particularly, to ultrasonic peening treatment of rotor components for gas turbines, steam turbines or hydro machines wherever shot peening is deemed necessary or desirable.

It is generally recognized that fatigue life for certain materials is enhanced when parts are shot peened. Peening induces a residual compressive stress that retards crack initiation. The most widely used peening technology involves a large quantity (many pounds) of small sized metallic or ceramic 'shot,' which is propelled at the component to be peened. In a shop environment, the small shot can be fairly easily cleaned from the component to avoid having it introduced into a working turbine.

In instances where rotor parts are repaired or modified in the field, parts may be required to be re-shot peened in order to introduce the compressive stress to resist cracking upon return to service. In a field application, however, a conventional shot peen process scatters shot widely about the work area, and the small pieces of shot are not easily retrieved from the turbine unit. Residual shot in the unit poses a threat to the operation of the turbine.

Forms of peening other than conventional exist, such as laser shock, water cavitation shock, and the like; however, these forms are either very expensive or not readily field adaptable.

Ultrasonic peening is a commercially available technology that generally uses a fixed computer-controlled machine in a shop environment to peen components of a fixed shape. This configuration generally requires either (1) the components to be a maximum size (such as a piece part), or (2) the machinery to be large scale in order to treat the component as specified. Existing applications of peening on rotor components typically perform the operation with separate pieces comprising the rotor rotating to the peening equipment or the peening equipment manipulating around the separate parts in a horizontal plane. As a consequence, the existing applications are not suitable for use in situ. Additionally, the existing applications lack equipment mobility and are typically unable to operate on a vertically rotating component.

Additionally, other shot peening methods (e.g., conventional, water jet cavitation, laser) require a "line-of-sight" such that the media doing the peening (metal or ceramic shot, water jet, laser beam) must be in line with the object to be peened or be able to ricochet and peen the surface of interest therein. With most processes, a line-of-sight is not available while the rotor is still in the casing and/or the rotor assembly is still intact.

An additional concern with conventional shot peening is that some of the shot would remain in the assembled rotor or casing, causing subsequent premature failure of other parts, such as buckets, nozzles or bearings, upon return to service. It would thus be desirable to enable a rotor component to be peened without disassembly and without potential contamination by shot media.

BRIEF DESCRIPTION OF THE INVENTION

In an exemplary embodiment of the invention, a system for ultrasonic peening treatment of assembled turbine rotor components includes an acoustic element that excites peening media within a peen chamber, and a frame attachable to an assembled component. The frame includes support structure engageable with the acoustic element, where the frame is cooperable with a chamber tooling that defines and encloses the peen chamber together with the assembled component.

In another exemplary embodiment of the invention, a method for performing ultrasonic peening treatment of assembled turbine rotor components includes the steps of attaching a frame to an assembled component; securing an acoustic element that excites peening media within a peen chamber to the frame; enclosing the peen chamber with a chamber tooling selectively engageable with the frame and the assembled component, the chamber tooling defining and enclosing the peen chamber together with the assembled component; and activating the acoustic element.

In still another exemplary embodiment of the invention, a system for ultrasonic peening treatment of an assembled turbine rotor wheel includes a frame attachable to the turbine rotor wheel and spanning circumferentially across at least three of the dovetail slots. The frame includes an attachment member shaped corresponding to the dovetail slots for axial sliding attachment to the rotor wheel. An acoustic element is securable to the frame that excites peening media within a peen chamber. At least two insert members are selectively engageable with the rotor wheel through the frame and the dovetail slots on either side of the attachment member, where the insert members define and enclose the peen chamber together with the turbine rotor wheel.

DETAILED DESCRIPTION OF THE INVENTION

Figure 1:
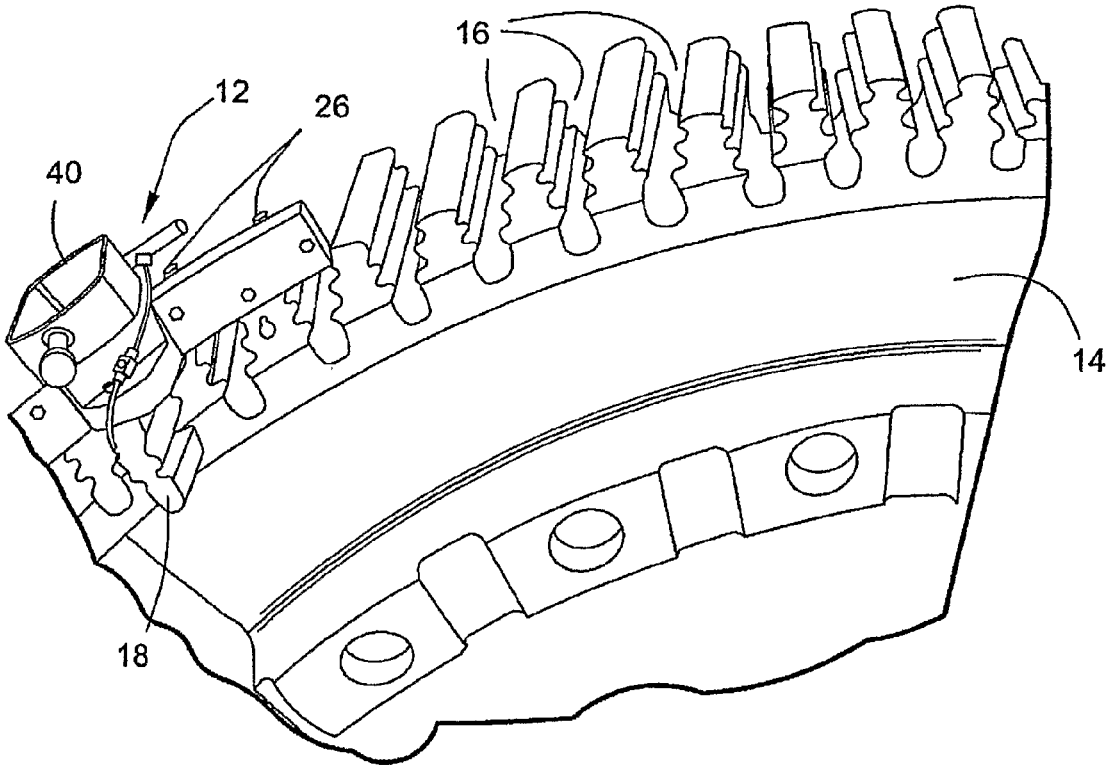
FIG. 1 shows a section of a turbine rotor wheel with attached ultrasonic peening treatment system.
Figure 2:
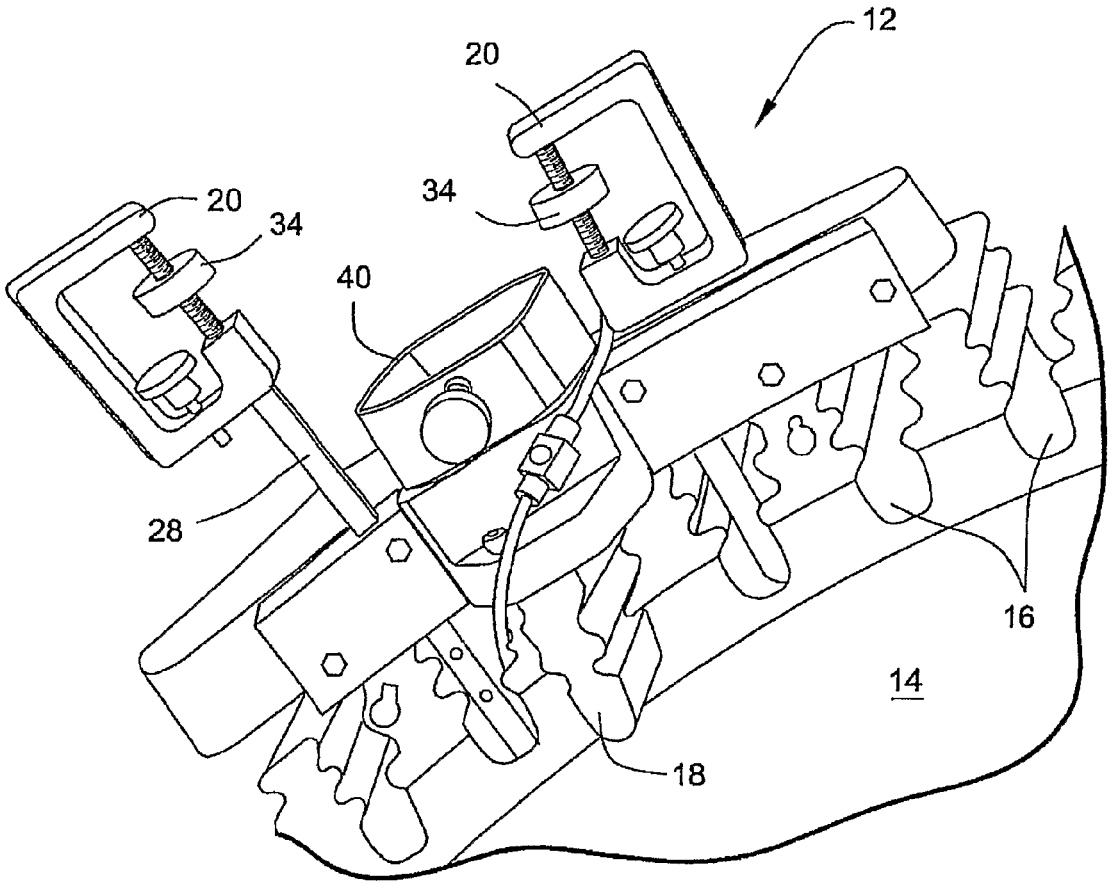
FIG. 2 illustrates the assembly process for securing the system to the rotor wheel.

With reference to FIGS. 1 and 2, a system for ultrasonic peening treatment of assembled turbine rotor components includes a frame 12 attachable to an assembled turbine rotor component. The rotor component shown in FIGS. 1 and 2 is a section of a turbine wheel 14. A typical turbine wheel 14 includes a plurality of dovetail slots 16 that receive correspondingly-shaped dovetails of turbine blades (not shown). The frame 12 includes a dovetail-shaped attachment 18 that slides axially into a dovetail slot 16 on the rotor wheel 14. Screws or other suitable securing structure fix the frame 12 in the slot 16.

Figure 3:
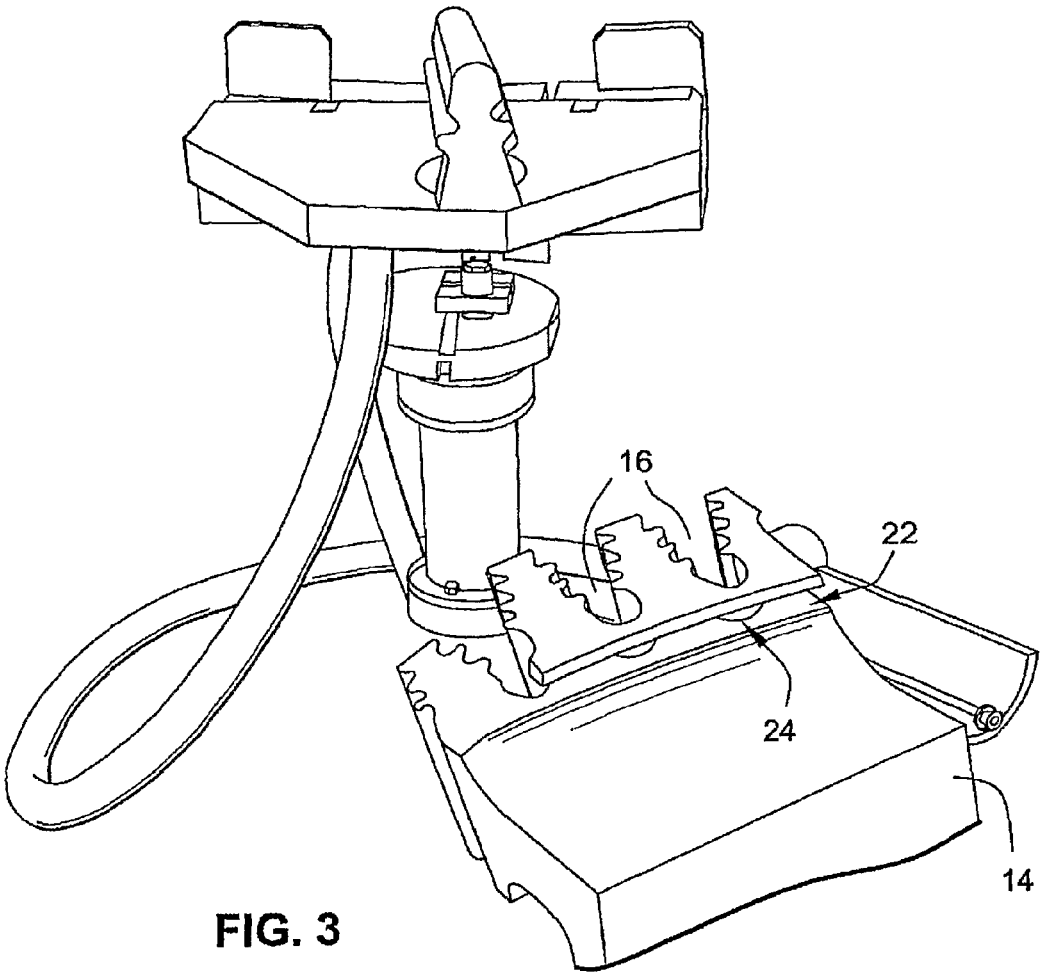
FIG. 3 shows a cooling groove of the rotor wheel.

As shown in FIG. 2, at least one insert member 20, possibly two or three, is selectively engageable with the frame 12 and the rotor wheel 14. More particularly, as shown in FIG. 3, the rotor wheel 14 includes a cooling passage defined by a cooling groove 22 extending circumferentially around the rotor wheel 14 and by an aperture 24 in each of the dovetail slots 16 opening to the cooling groove 22. The frame 12 is provided with multiple apertures 26 that are spaced from each other corresponding to a space between each of the dovetail slots 16. The frame 12 is positioned on the rotor wheel 14 such that the apertures 26 are disposed in alignment with the dovetail slots 16. In this manner, the insert members 20 include an articulated shaft 28 that is extendible through the aperture 26 in the frame 12 and into the cooling groove 22 through the aperture 24.

Figure 4:
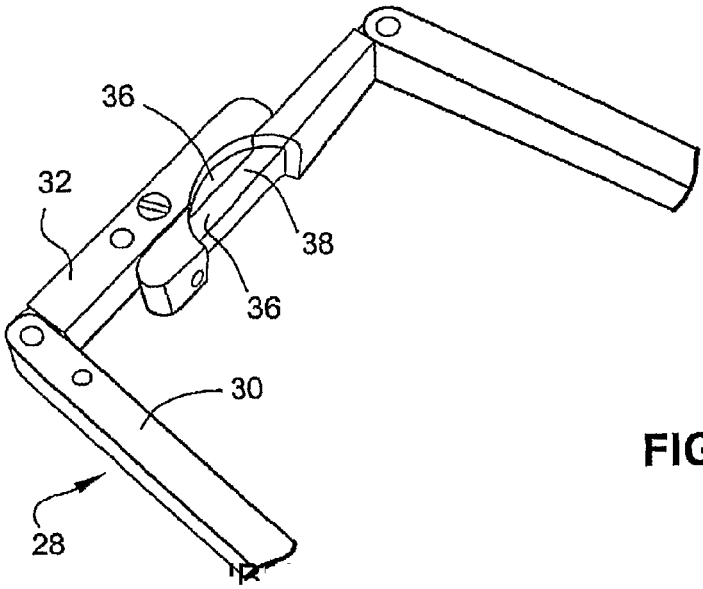
FIG. 4 is a closer view of the insert members.

As shown in FIG. 4, the insert members 20 are generally formed of the articulated shaft 28 including an insert leg 30 and a pivot leg 32. During assembly, the insert leg 30 and the pivot leg 32 are generally aligned to define a straight shaft for insertion through the apertures 26 and the frame 12. After the articulated shaft 28 is inserted through the frame 12 and through aperture 24 in the dovetail slot 16, an adjusting mechanism 34 is actuated to pivot the pivot leg 32 relative to the insert leg 30 such that the pivot leg 32 engages the cooling groove 22 of the rotor wheel 14. Any suitable gearing structure or the like may be utilized to cause the pivot leg 32 to pivot when the adjusting mechanism 34 is rotated. In this manner, the insert member 20 including the articulated shaft 28 serves to define and enclose a peen chamber together with the rotor wheel 14. In a preferred embodiment, with continued reference to FIG. 4, the pivot legs 32 of adjacent insert members 20 are pivoted into engagement with the cooling groove 22 in a preset order and include respective grooves 36 to cooperatively define a portion 38 of the peen chamber.

With the insert members 20 secured to the frame 12 and the pivot legs 32 secured in the cooling groove 22, a peen chamber is defined with the rotor wheel 14 that is entirely enclosed such that peening media within the peen chamber are prevented from escaping the peen chamber. In other arrangements such as those without a cooling groove, the insert members may be unnecessary where the enclosed peen chamber can be defined via suitable tooling or the like.

Figure 5:
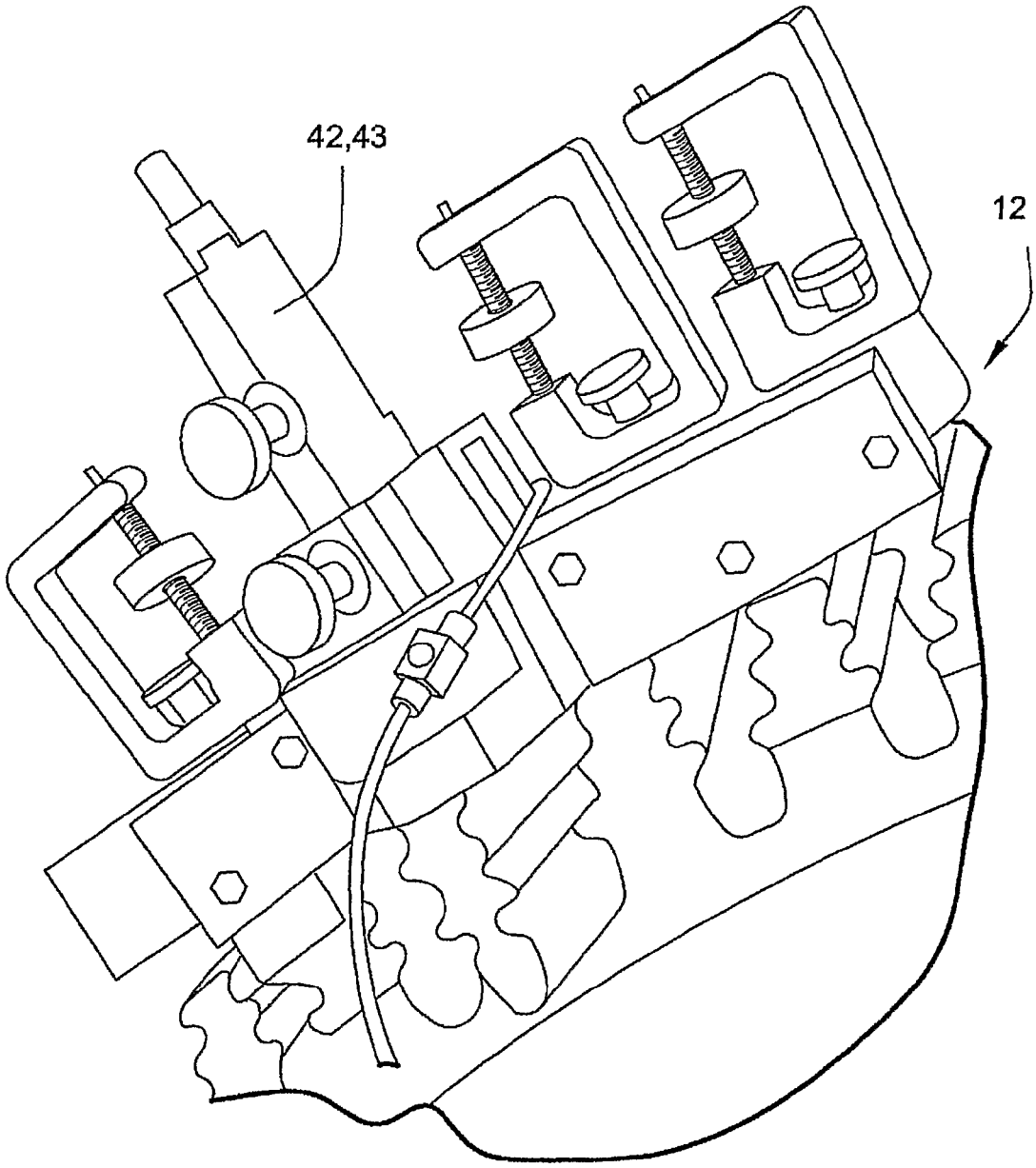
FIG. 5 illustrates a tooling for delivering or removing peening media from the peen chamber.

Once the frame 12 is secured in place, and the insert members 20 are positioned and configured to define the peen chamber, the unit is ready to perform the ultrasonic peening treatment. The frame 12 includes support structure 40 in communication with the peen chamber that receives various tooling for use and operation of the system. FIG. 5 illustrates an exemplary tooling 42 coupled with the support structure 40 for delivering a preset number of peening media into the peen chamber. The tooling 42 is meant to be generic as peening media can be introduced into the peen chamber in multiple ways, including via a tool with a plunger, being poured into the chamber, etc.

Figure 6:
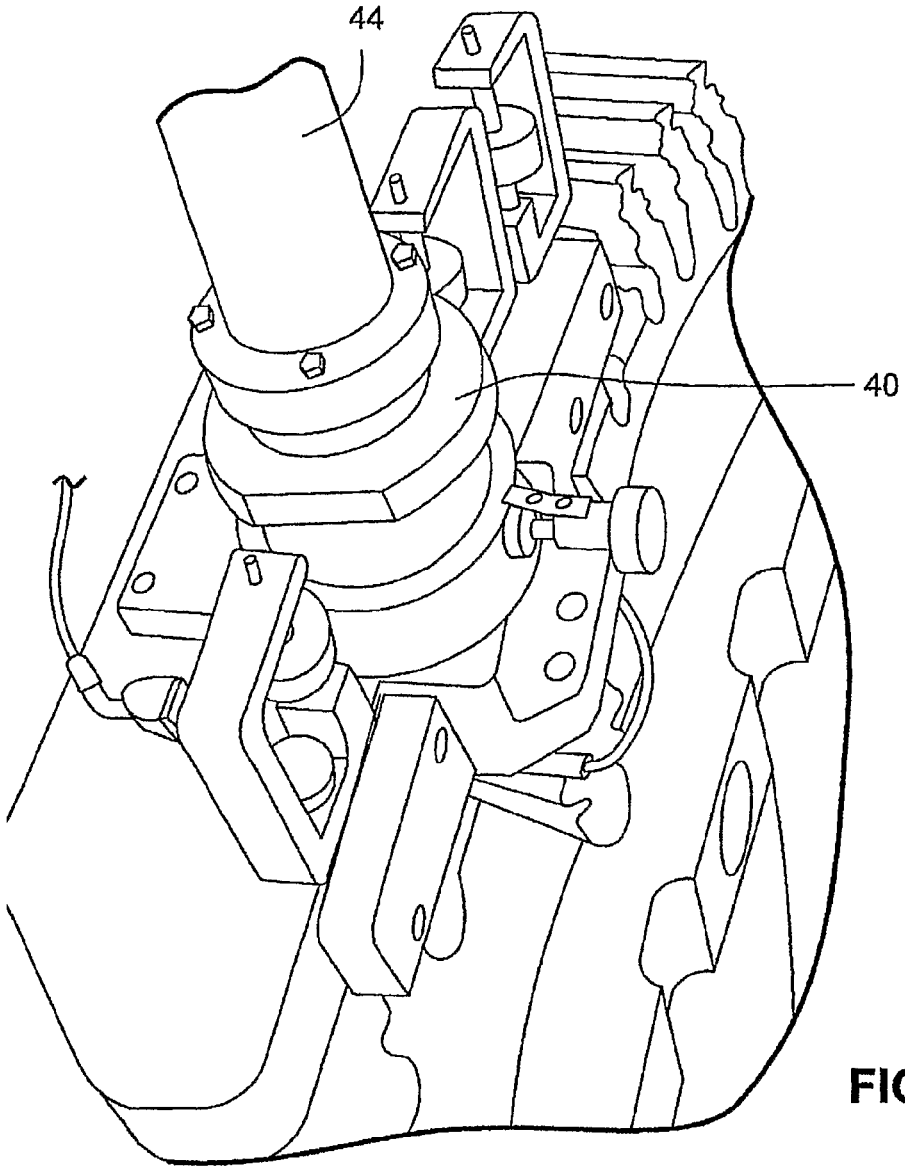
FIG. 6 illustrates the system with the attached acoustic element.

After delivering peening media to the peen chamber, the delivery tooling 42 is removed, and an acoustic element 44 (see FIG. 6) is coupled with the support structure 40 and activated to excite the peening media within the peen chamber. The use and operation of the acoustic element 44 are known, and further details thereof will not be described.

Figure 7:
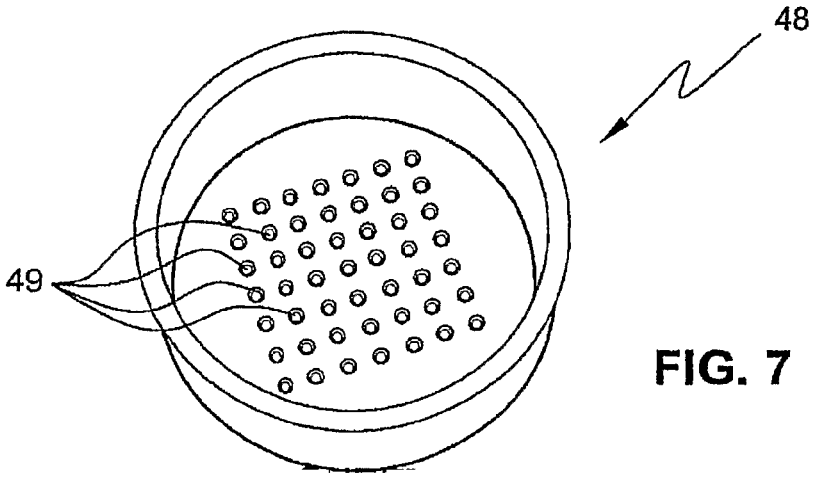
FIG. 7 shows exemplary structure for ensuring that all peening media is removed from the peen chamber.

After the peening treatment is complete, the acoustic element 44 is removed, and a removal tooling 43 (FIG. 5) for removing peening media from the peen chamber is attached to the support structure 40. The tooling 43 for removing peening media includes structure for ensuring that the preset number of peening media is removed from the peen chamber. For example, the removal tooling 43 may incorporate a grid frame 48 as shown in FIG. 7. The grid frame 48 receives the peening media via the removal tooling 43 and includes a plurality of apertures 49, one each for each member of the peening media. In this manner, the operator can quickly and easily make a visual determination of whether all of the peening media has been removed form the peen chamber. In one exemplary embodiment, the removal tooling 43 utilizes a vacuum structure for removing peen from the peen chamber.

Although the description herein provides details of an application to ultrasonic peening treatment of a turbine rotor wheel, the invention is not necessarily meant to be limited to this application. Rather, the system and method are applicable to ultrasonic peening on steam, gas or hydro turbine rotor components where application of a compressive stress is desirable to reduce the incidence of crack formation on highly stressed parts. The treatment system and method allow for the application of ultrasonic peening to be performed in field applications without requiring removal of the rotor from the machine. In an alternative exemplary application, the system could be utilized for peening the area of the lock wire tabs of a turbine bucket dovetail. In this instance, the peen chamber would be defined and enclosed by the tooling around the dovetail post, and excitement of the peening media could be carried out in the same manner as discussed above.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A system for ultrasonic peening treatment of assembled components, the system comprising:

an acoustic element that excites peening media within a peen chamber;

a frame attachable to an assembled component, the frame including support structure engageable with the acoustic element, wherein the frame is cooperable with a chamber tooling that defines and encloses the peen chamber together with the assembled component; and a peen insert tooling engageable with the frame support structure, the peen insert tooling delivering a preset number of peening media into the peen chamber.

2. A system according to claim 1, further comprising a peen removal tooling engageable with the frame support structure, the peen removal tooling removing peening media from the peen chamber, wherein the peen removal tooling comprises a counter that ensures that the preset number of peening media is removed from the peen chamber.

3. A system according to claim 2, wherein the counter comprises a grid frame including an aperture for each of the preset number of peening media.

4. A system according to claim 1, wherein the assembled component comprises a turbine rotor wheel including a plurality of dovetail slots, and wherein the frame comprises a dovetail attachment shaped corresponding to the wheel dovetail slots for axial sliding attachment to the rotor wheel.

5. A system for ultrasonic peening treatment of assembled components, the system comprising:

an acoustic element that excites peening media within a peen chamber; and a frame attachable to an assembled component, the frame including support structure engageable with the acoustic element, wherein the frame is cooperable with a chamber tooling that defines and encloses the peen chamber together with the assembled component, wherein the assembled component comprises a turbine rotor wheel including a plurality of dovetail slots, and wherein the frame comprises a dovetail attachment shaped corresponding to the wheel dovetail slots for axial sliding attachment to the rotor wheel, wherein the chamber tooling comprises at least one insert member selectively engageable with the frame and the turbine rotor wheel, wherein the rotor wheel further includes a cooling passage defined by a cooling groove extending circumferentially around the rotor wheel and by an aperture in each of the dovetail slots opening to the cooling groove, and wherein the insert member is extendable through the frame and into the cooling groove through the aperture.

6. A system according to claim 5, wherein the insert member comprises an articulated shaft having an insert leg and a pivot leg, the pivot leg being selectively pivotable relative to the insert leg, wherein the insert leg and the pivot leg are extendable through the frame and through the aperture, and the pivot leg is subsequently pivotable to engage the cooling groove.

7. A system according to claim 6, comprising two insert members extendable through the frame and into the cooling groove on opposite sides of the dovetail attachment, wherein the pivot legs of the insert members are pivotable to engage the cooling groove and cooperatively define a portion of the peen chamber.

8. A method for performing ultrasonic peening treatment of assembled components, the method comprising:

attaching a frame to an assembled component;

securing an acoustic element that excites peening media within a peen chamber to the frame;

enclosing the peen chamber with a chamber tooling selectively engageable with the frame and the assembled component, the chamber tooling defining and enclosing the peen chamber together with the assembled component; and activating the acoustic element, wherein the assembled component comprises a turbine rotor wheel including a plurality of dovetail slots, and wherein the frame includes a dovetail attachment shaped corresponding to the wheel dovetail slots, the attaching step being practiced by axially sliding the dovetail attachment one of the dovetail slots of the rotor wheel, wherein the chamber tooling comprises at least one insert member, and wherein the rotor wheel further includes a cooling passage defined by a cooling groove extending circumferentially around the rotor wheel and by an aperture in each of the dovetail slots opening to the cooling groove, the enclosing step comprising extending the insert member through the frame and into the cooling groove through the aperture.

9. A method according to claim 8, further comprising, prior to the securing step, delivering a preset number of peening media into the peen chamber.

10. A method according to claim 9, further comprising, after the activating step, removing peening media from the peen chamber with peen removal tooling, and ensuring that the preset number of peening media is removed from the peen chamber.

11. A method according to claim 8, wherein the insert member comprises an articulated shaft having an insert leg and a pivot leg, the pivot leg being selectively pivotable relative to the insert leg, the enclosing step further comprising extending the insert leg and the pivot leg through the frame and through the aperture, and subsequently pivoting the pivot leg to engage the cooling groove.

12. A method according to claim 11, wherein the enclosing step comprises extending two insert members through the frame and into the cooling groove on opposite sides of the dovetail attachment, and pivoting the pivot legs of the insert members to engage the cooling groove and cooperatively define a portion of the peen chamber.

13. A system for ultrasonic peening treatment of an assembled turbine rotor wheel, the rotor wheel including a plurality of dovetail slots for receiving bucket dovetails of turbine buckets, the system comprising:

a frame attachable to the turbine rotor wheel and spanning circumferentially across at least three of the dovetail slots, the frame including an attachment member shaped corresponding to the dovetail slots for axial sliding attachment to the rotor wheel;

an acoustic element securable to the frame, the acoustic element exciting peening media within a peen chamber; and at least two insert members selectively engageable with the rotor wheel through the frame and the dovetail slots on either side of the attachment member, the insert members defining and enclosing the peen chamber together with the turbine rotor wheel.

* * * * *